US009266160B2

(12) United States Patent
Nakamura et al.

(10) Patent No.: US 9,266,160 B2
(45) Date of Patent: Feb. 23, 2016

(54) METHOD FOR FORMING AN UNDERCUT AND METHOD FOR MANUFACTURING A FORMED ARTICLE HAVING AN UNDERCUT

(75) Inventors: Yoshiharu Nakamura, Hamamatsu (JP); Akihiro Yamashita, Hamamatsu (JP); Yuji Otsuka, Hamamatsu (JP)

(73) Assignee: KABUSHIKI KAISHA F.C.C., Shizuoka (JP)

( * ) Notice: Subject to any disclaimer, the term of this patent is extended or adjusted under 35 U.S.C. 154(b) by 374 days.

(21) Appl. No.: 13/261,603

(22) PCT Filed: Aug. 25, 2011

(86) PCT No.: PCT/JP2011/069144

§ 371 (c)(1), (2), (4) Date: May 21, 2013

(87) PCT Pub. No.: WO2012/026515

PCT Pub. Date: Mar. 1, 2012

(65) Prior Publication Data

US 2013/0228001 A1 Sep. 5, 2013

(30) Foreign Application Priority Data

Aug. 27, 2010 (JP) ..... 2010-191574

(51) Int. Cl.
*B21D 11/20* (2006.01)
*B21D 22/02* (2006.01)

(52) U.S. Cl.
CPC ..... *B21D 11/20* (2013.01); *B21D 22/02* (2013.01)

(58) Field of Classification Search
CPC ..... B21D 11/10; B21D 11/20; B21D 22/02; B21D 22/24; B21D 24/005; B21D 31/005; B21D 35/001; B21D 35/002; B21D 37/08; B21D 51/10; B21D 53/88; B21K 1/26
See application file for complete search history.

(56) References Cited

U.S. PATENT DOCUMENTS

2011/0016944 A1* 1/2011 Tamai ..... 72/358

FOREIGN PATENT DOCUMENTS

| | | |
|---|---|---|
| JP | 09276934 | 10/1997 |
| JP | 10058040 | 3/1998 |
| JP | 2005003096 | 1/2005 |

* cited by examiner

*Primary Examiner* — Debra Sullivan
(74) *Attorney, Agent, or Firm* — Michael Tobias

(57) ABSTRACT

A method for forming an undercut portion of a formed article formed by plastically deforming a plate-shaped workpiece and a method for manufacturing a formed article having an undercut portion are provided. In these methods, the undercut portion is formed by press working performed using a punch and a die. These methods make the forming work more economical and more efficient. An outer portion of a plate member 91 (plate-shaped workpiece) located outward of a portion where an inwardly inclined portion 94 (undercut portion) is to be formed is bent by an angle determined such that an undercut surface 94*a* which constitutes the inwardly inclined portion 94 becomes parallel to the pressing direction of a punch 110. In addition, a peripheral wall portion 93 inclined by an angle corresponding to the bending angle is formed on the outer portion. The bent portion of the plate member 91 having the inclined peripheral wall portion 93 is bent back in the opposite direction so as to cause the inwardly inclined portion 94 to rise up from the surface of the plate member 91.

10 Claims, 6 Drawing Sheets

METHOD FOR FORMING AN UNDERCUT AND METHOD FOR MANUFACTURING A FORMED ARTICLE HAVING AN UNDERCUT

TECHNICAL FIELD

The present invention relates to a method for forming an undercut portion and a method for manufacturing a formed article having an undercut portion wherein the undercut portion is formed by plastically deforming a plate-shaped workpiece by press working performed using a punch and a die.

BACKGROUND ART

Articles which have conventionally been formed by plastically deforming a plate-shaped workpiece by bending include articles which have an undercut portion while maintaining a plate-like shape. For example, a lockup damper apparatus of a torque converter disclosed in below-listed Patent Document 1 uses a rotary member called a "piston". The rotary member is a circular plate which is formed from steel plate and which has a peripheral portion which is raised or bent upward. A distal end portion of the raised portion slants inward to thereby form an undercut portion.

PRIOR ART DOCUMENT

Patent Document

Patent Document 1: Japanese Patent Application Laid-Open (kokai) No. 2005-3096

In general, such an article having an undercut portion cannot be formed by press working using a punch which moves in only one direction relative to a die. Therefore, such an article is formed by other types of press working, such as flow forming or slide-core-type press working which is performed using a slide core.

However, problems arise if an additional step, such as a step of flow forming, is added so as to form an undercut portion during the process of forming an article by press working performed using a punch and a die. Specifically, equipment required for the additional step increases the cost and man-hours required for maintenance. In addition, the process of forming an article becomes complex, resulting in an increase in the time required for forming and a reduction in working efficiency. Also, in the case of press working performed using a slide core, a mechanism for moving the slide core is needed and the die becomes complex, resulting in increases in the cost of the die equipment and the man-hours required for maintaining the die equipment.

The present invention was accomplished in order to solve the above-described problems, and its object is to provide an improved method for forming an undercut portion of an article formed by plastically deforming a plate-shaped workpiece and an improved method for manufacturing a formed article having an undercut portion. In the improved methods, the undercut portion is formed by press working performed using a punch and a die, whereby the economic efficiency and working efficiency of the forming work can be improved.

SUMMARY OF THE INVENTION

In order to achieve the above-described object, the invention recited in claim 1 is provided. The invention is a method for forming an undercut portion in a press working process in which a plate-shaped workpiece is plastically deformed so as to obtain a formed article by using a punch for pressing the workpiece and a die for receiving the workpiece pressed by the punch. The method is characterized by comprising a bending step of bending an outer portion of the workpiece in the pressing direction of the punch, the outer portion being located outward of a reference point located on the inner side of a portion of the workpiece where the undercut portion is to be formed; an outer portion forming step of forming the outer portion of the workpiece into a target shape of the outer portion including the undercut portion; and a bend removal step of bending the outer portion of the workpiece at the reference point in a direction opposite the bending direction by an angle equal to the angle by which the outer portion was bent to thereby remove the bend formed by the bending step.

According to the feature of the invention of claim 1, a point on the plate-shaped workpiece located on the inner side of a portion where the undercut portion is to be formed is defined as a reference point, and an outer portion of the workpiece located outward of the reference point is bent in the pressing direction of the punch to thereby form the outer portion into the target shape of the outer portion. Subsequently, the outer portion is bent in the opposite direction to thereby form the undercut portion. Namely, the orientation of the part of the plate-shaped workpiece where the undercut portion is to be formed is once changed such that that part does not form an undercut shape as viewed in the direction of movement of the punch, whereby the portion for constituting the undercut shape is formed. After that, the changed orientation is restored to the original orientation. By virtue of this procedure, an article having an undercut portion can be formed just by press working performed using a punch and a die. As a result, the economic efficiency and working efficiency of the process of forming the article having an undercut portion can be improved. The bending angle of the outer portion of the workpiece located outward of the reference point is equal to or greater than an angle at which the undercut surface which constitutes the undercut portion becomes parallel to the pressing direction of the punch. In other words, the bending angle falls within an angular range extending up to the angle at which the outer portion and the undercut surface (including a portion which is to become the undercut surface) become parallel to the pressing direction of the punch.

The feature of the invention of claim 2 resides in the bending step and the outer portion forming step being simultaneously performed on the workpiece.

According to the feature of the invention of claim 2, the working for bending the outer portion which forms the undercut portion and the working for forming the outer portion into the target shape are simultaneously performed on the workpiece. As a result, an article having an undercut portion can be efficiently formed.

The feature of the invention of claim 3 resides in the forming method further comprising a finishing step which is performed after the bend removal step so as to again form the outer portion of the workpiece into the target shape of the outer portion excluding the undercut portion.

According to the feature of the invention of claim 3, after the outer portion having an undercut portion formed thereon is bent in the opposite direction so as to correct the bent shape, the outer portion is re-struck, i.e., the outer portion is again formed into the target shape of the outer portion excluding the undercut portion. As a result, deformation of the outer portion of the article where the undercut portion is formed caused by spring back or spring go (i.e., spring action in the direction opposite the direction of spring back) after the press working can be corrected. Thus, the press working accuracy of the formed article can be improved.

The present invention can be implemented not only as a method for forming an undercut portion but also as a method for manufacturing a formed article having an undercut portion.

Specifically, as recited in claim 4, there is provided a method for manufacturing a formed article having an undercut portion by a press working process in which a plate-shaped workpiece is plastically deformed using a punch for pressing the workpiece and a die for receiving the workpiece pressed by the punch. The method is characterized by comprising a bending step of bending an outer portion of the workpiece in the pressing direction of the punch, the outer portion being located outward of a reference point located on the inner side of a portion of the workpiece where the undercut portion is to be formed; an outer portion forming step of forming the outer portion of the workpiece into a target shape of the outer portion including the undercut portion; and a bend removal step of bending the outer portion of the workpiece at the reference point in a direction opposite the bending direction by an angle equal to the angle by which the outer portion was bent to thereby remove the bend formed by the bending step.

As recited in claim 5, in the method for manufacturing a formed article having an undercut portion, the bending step and the outer portion forming step are preferably simultaneously performed on the workpiece.

As recited in claim 6, the method for manufacturing a formed article having an undercut portion preferably further comprises a finishing step which is performed after the bend removal step so as to again form the outer portion of the workpiece into the target shape of the outer portion excluding the undercut portion.

BRIEF DESCRIPTION OF THE DRAWINGS

FIGS. 1(A) and 1(B) show the external configuration of a side plate which is to be formed by an undercut portion forming method according to one embodiment of the present invention, wherein FIG. 1(A) is a plan view of the side plate, and FIG. 1(B) is a cross-sectional view of the side plate taken along line A-A in FIG. 1(A).

FIGS. 2(A) and 2(B) are explanatory views used for describing a step of forming a peripheral wall portion on a plate member during a process of forming the side plate shown in FIGS. 1(A) and 1(B), wherein FIG. 2(A) is a cross-sectional view showing a state in which the plate member is placed on a die, and FIG. 2(B) is a cross-sectional view showing a state at the time of press working of the plate member.

FIGS. 3(A) and 3(B) are explanatory views used for describing a step of correcting the inclination of the peripheral wall portion of the plate member during the process of forming the side plate shown in FIGS. 1(A) and 1(B), wherein FIG. 3(A) is a cross-sectional view showing a state in which the plate member is placed on a die, and FIG. 3(B) is a cross-sectional view showing a state at the time of press working of the plate member.

FIGS. 4(A) and 4(B) are explanatory views used for describing a step of correcting the peripheral wall portion of the plate member for finishing the same during the process of forming the side plate shown in FIGS. 1(A) and 1(B), wherein FIG. 4(A) is a cross-sectional view showing a state in which the plate member is placed on a die, and FIG. 4(B) is a cross-sectional view showing a state at the time of press working of the plate member.

MODE FOR CARRYING OUT THE INVENTION

Figure 1A:
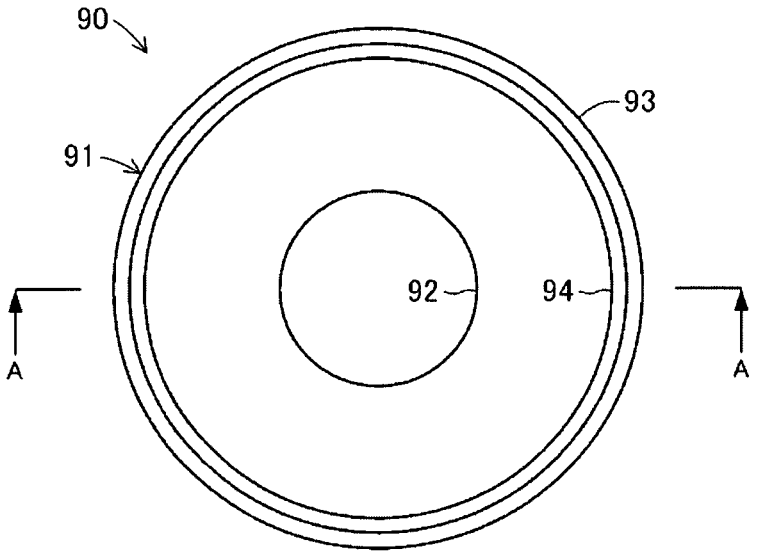
Figure 1B:
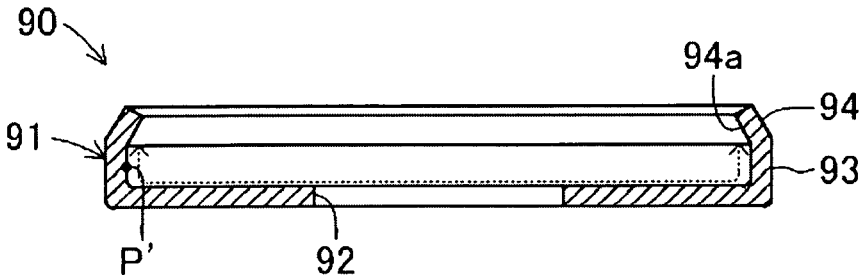

One embodiment of an undercut portion forming method according to the present invention will now be described with reference to the drawings. FIGS. 1(A) and 1(B) show the external configuration of a side plate 90, which is an article to be formed by the undercut portion forming method of the present invention, wherein FIG. 1(A) is a plan view of the side plate 90, and FIG. 1(B) is a schematic cross-sectional view of the side plate 90 taken along line A-A in FIG. 1(A). FIGS. 2(A) and 2(B) through FIGS. 4(A) and 4(B) are cross-sectional views schematically showing a state in which the side plate 90 is formed by the undercut portion forming method of the present invention. In each of the drawings which will be referred to herein, some components are shown schematically, such as in an exaggerated manner so as to facilitate an understanding of the present invention. Therefore, the dimensions, dimensional ratios, etc. of the constituent elements may differ from the actual dimensions, dimensional ratios, etc.

First, the side plate 90, which is an article to be formed by the undercut portion forming method of the present invention, will be described. The side plate 90 is a component of a lockup damper apparatus of a torque converter mounted on a vehicle such as an automobile. The side plate 90 is a circular plate which has a raised peripheral edge portion and a disk-like shape. More specifically, the side plate 90 is constituted by forming a through hole 92 in and a peripheral wall portion 93 on a plate member 91, which is formed by punching an unillustrated workpiece made of steel plate (e.g., JSH270C) into a circular shape. In this case, the through hole 92 is a hole formed by a central portion of the plate member 91 being punched into a circular shape simultaneously with the punching of the plate member 91.

The peripheral wall portion 93 is a portion to be formed by the undercut portion forming method of the present invention. It is formed by bending upward a peripheral edge portion of the plate member 91 such that the bent portion forms a wall which extends vertically. At its distal end, the peripheral wall portion 93 has an inwardly inclined portion 94 which is inclined towards the center of the plate member 91. This inwardly inclined portion 94 corresponds to the undercut portion. In the present embodiment, the inwardly inclined portion 94 is formed such that it is inclined towards the center of the plate member 91 by about 30° in relation to the peripheral wall portion 93.

Next, die mechanisms used for press forming the side plate 90 by the undercut portion forming method of the present invention will be described. In the present embodiment, three die mechanisms 100, 200, and 300 are used in order to press form the peripheral edge portion of the side plate 90. These three die mechanisms 100, 200, and 300 are mainly composed of punches 110, 210, and 310 which are so-called male dies to be pressed against the plate member 91, which is a workpiece for forming the side plate 90, and dies 120, 220, and 320 which are so-called female dies for receiving the plate member 91 pressed by the punches 110, 210, and 310, respectively.

Figure 2A:
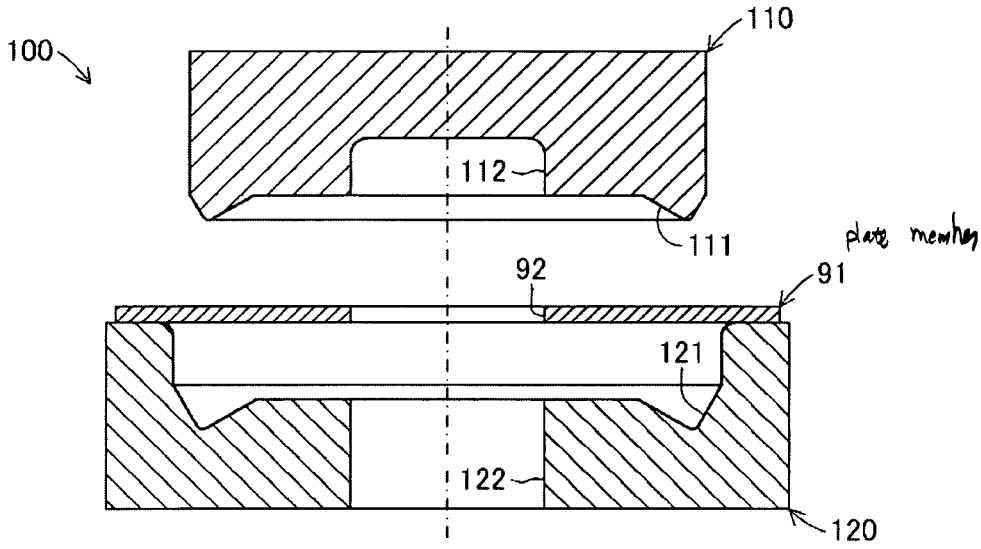
Figure 2B:
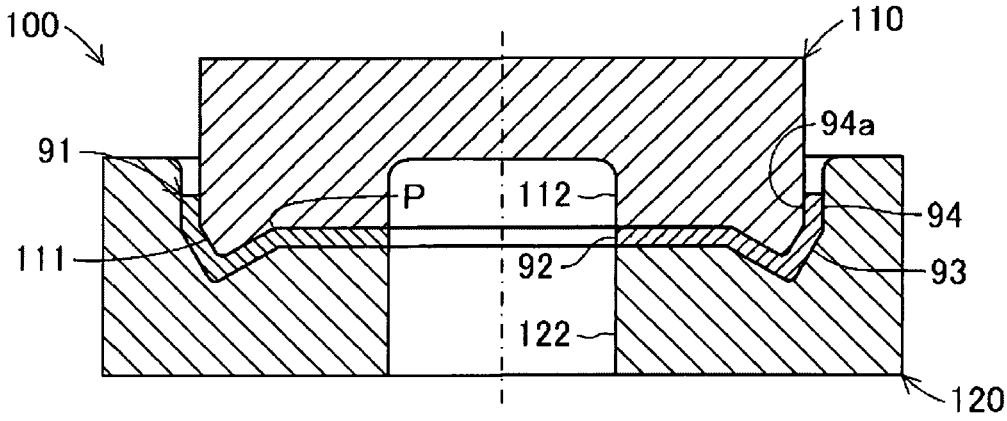

Of these die mechanisms, die mechanism 100 is used to perform press working on the ring-shaped plate member 91 having the through hole 92 so as to form the peripheral wall portion 93 in an inclined state as specifically shown in FIGS. 2(A) and 2(B). The punch 110 of die mechanism 100 is formed of die steel and generally has a circular columnar shape. A ring-shaped male die portion 111 is formed on the bottom surface of the punch 110. The male die portion 111 projects downward from the bottom surface so as to form the plate member 91 into a desired shape. A blind relief hole 112 which coincides in position with the through hole 92 of the side plate 90 is formed at the center of the bottom surface of the punch 110. The die 120 of die mechanism 100 is formed of die steel and generally has a ring-like shape. A female die portion 121 is formed on the top surface of the die 120. The female die portion 121 is recessed so as to form the plate member 91 into a desired shape. A through hole 122 which coincides in position with the through hole 92 of the side plate 90 is formed at the center of the die 120.

The male die portion 111 and the female die portion 121 are formed such that when a position on the plate member 91 located on the inner side of the inwardly inclined portion 94 (within a region indicated by the dashed line arrows in FIG. 1(B)) is defined as a reference point, an outer portion of the plate member 91 located on the outer side of the reference point can be bent in the pressing direction of the punch 110, and the peripheral wall portion 93 which is inclined by an angle corresponding to the bending angle of the outer portion can be formed on the outer portion of the bent plate member 91. In this case, the angle by which the plate member 91 is bent in the pressing direction of the punch 110 is determined such that the undercut surface 94*a* of the inwardly inclined portion 94 becomes parallel to the pressing direction of the punch 110. In the present embodiment, the plate member 91 is bent downward by 30° in the pressing direction of the punch 110 with respect to the horizontal direction in which the plate member 91 extends.

Figure 3A:
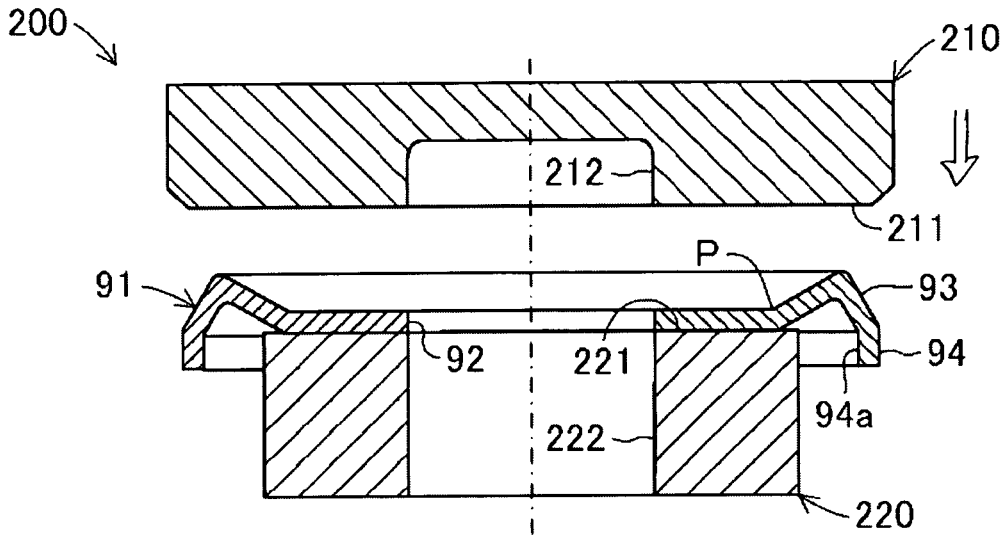
Figure 3B:
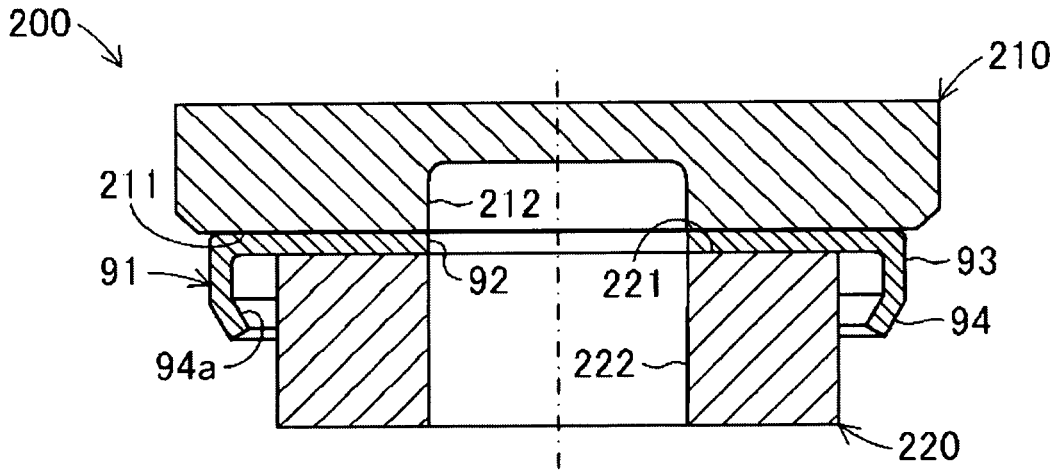

As shown in detail in FIGS. 3(A) and 3(B), die mechanism 200 is a die mechanism for carrying out forming on the bent portion of the plate member 91 which has been bent in the pressing direction of the punch 110 by die mechanism 100 such that the bent portion is formed into a flat planar shape, which is the final or target shape of the side plate 90. The punch 210 of die mechanism 200 is formed of die steel and generally has a circular columnar shape. A flat male die portion 211 having an annular shape is formed on the bottom surface of the punch 210 so as to form an outer surface (an upper surface in the drawings) of the plate member 91, which surface extends in the radial direction. A blind relief hole 212 which coincides in position with the through hole 92 of the side plate 90 is formed at the center of the bottom surface of the punch 210. The outer diameter of the male die portion 211 is made slightly greater than that of the side plate 90.

The die 220 of die mechanism 200 is formed of die steel and generally has a ring-like shape. A flat female die portion 221 is formed on the top surface of the die 220 so as to form an inner surface (a lower surface in the drawings) of the plate member 91, which surface extends in the radial direction. A through hole 222 which coincides in position with the through hole 92 of the side plate 90 is formed at the center of the die 220. The outer diameter of the female die portion 221 is made slightly greater than the diameter of the bent portion of the plate member 91 and smaller than the inner diameter of the inwardly inclined portion 94 of the side plate 90.

Figure 4A:
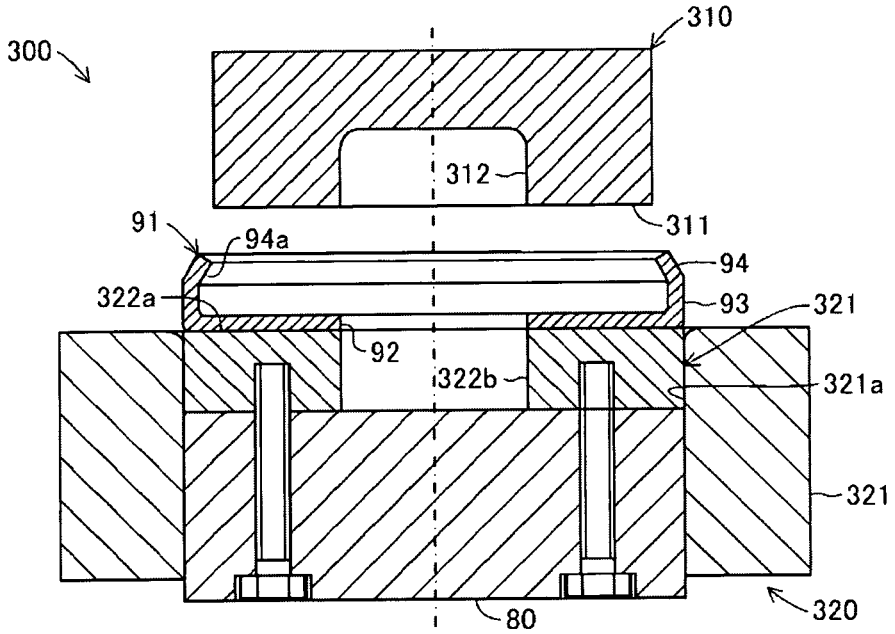
Figure 4B:
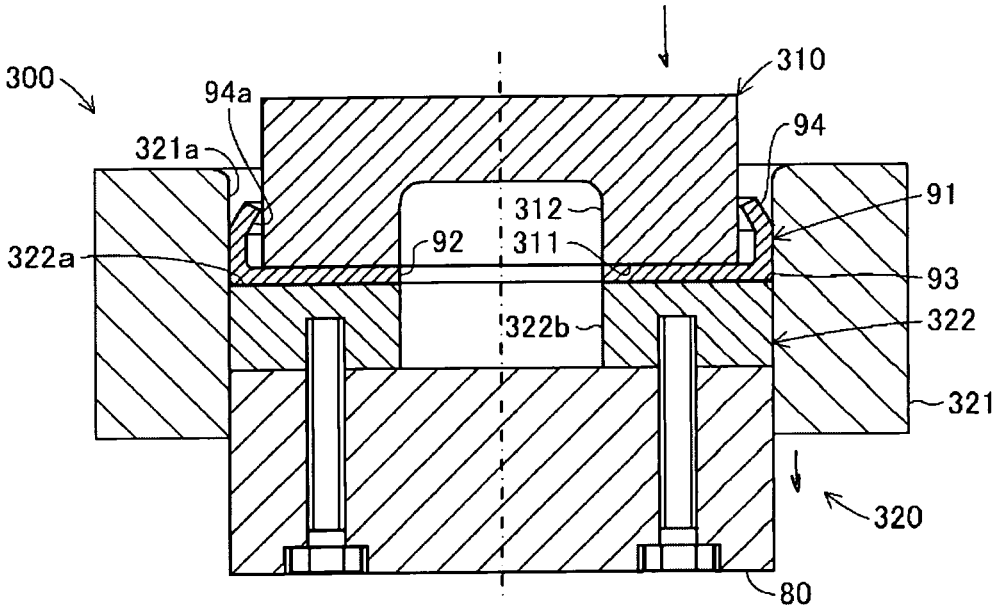

As shown in detail in FIGS. 4(A) and 4(B), die mechanism 300 is a die mechanism for finishing the plate member 91, which has been approximately formed into the final or target shape of the side plate 90 by die mechanism 200, such that the plate member 91 has the final or target shape. The punch 310 of die mechanism 300 is formed of die steel and generally has a circular columnar shape. A flat male die portion 311 having an annular shape is formed on the bottom surface of the punch 310 so as to form the inner surface (the upper surface in the drawings) of the plate member 91, which surface extends in the radial direction. A blind relief hole 312 which coincides in position with the through hole 92 of the side plate 90 is formed at the center of the bottom surface of the punch 310. The outer diameter of the male die portion 311 is selected such that it is slightly smaller than the diameter of the upper end of the undercut surface 94*a*, which is the inner surface of the inwardly inclined portion 94 of the side plate 90, i.e., such that the male die portion 311 loosely fits in the upper end of the undercut surface 94*a*.

The die 320 of die mechanism 300 is composed of an outer die 321 and an inner die 322, each of which is formed of die steel and has a ring-like shape. The inner die 322 is disposed inside the outer die 321. The outer die 321 is a die for forming the outer circumferential surface of the plate member 91, and a forming through hole 321*a* for forming the side plate 90 to have a final or target outer diameter is formed at the center thereof. The inner die 322 is a die for forming the outer surface (the lower surface in the drawings) of the plate member 91 extending in the radial direction. A flat female die portion 322*a* having a generally annular shape for forming the plate member 91 is formed on the top surface of the inner die 322.

A through hole 322*b* which coincides in position with the through hole 92 of the side plate 90 is formed at the center of the inner die 322. The outer diameter of the female die portion 322*a* is selected such that the female die portion 322*a* can slide within the forming through hole 321*a* of the outer die 321, i.e., the outer diameter of the female die portion 322*a* is made slightly smaller than the inner diameter of the forming through hole 321*a* such that the female die portion 322*a* loosely fits into the forming through hole 321*a*. Each of these die mechanisms 100, 200, and 300 is attached to an unillustrated pressing machine which bends and plastically deforms a workpiece in the form of the plate member 91.

The outer die 321 of the die 320 of die mechanism 300 is fixed on the pressing machine, and the inner die 322 thereof is fixed on a die receiving section 80 of the pressing machine such that the inner die 322 is slidably fit into the forming through hole 321*a* of the outer die 321. The die receiving section 80 of the pressing machine is a member which supports the inner die 322 while being pressed towards the punch 310 (upward in the drawings).

Figure 5:
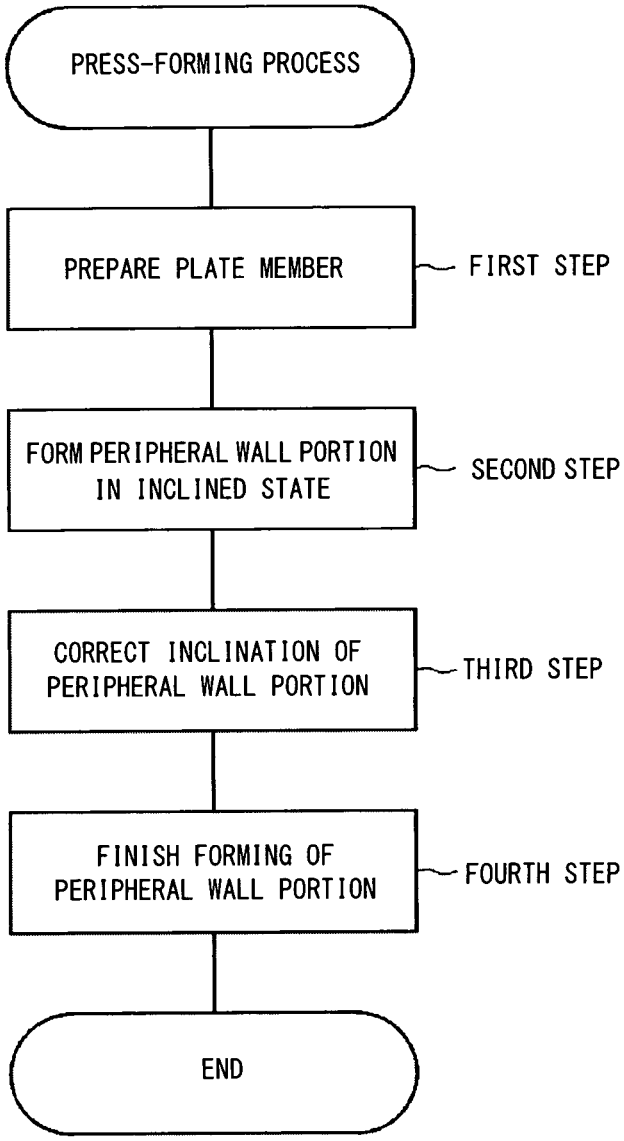
FIG. 5 is a flowchart showing the steps of a process of press forming a side plate by the undercut portion forming method according to the embodiment of the present invention.

Next, a method of forming an undercut portion using the die mechanisms 100, 200, and 300 configured as described above will be described with reference to the process flowchart shown in FIG. 5. FIG. 5 is a flowchart showing the steps of press forming the side plate 90.

First, an operator prepares the plate member 91 in the first step. Specifically, the operator punches a workpiece (not shown) formed of steel plate (JSH270C) using an unillustrated punching press into a ring shape to form the plate member 91. The outer diameter of the plate member 91 is selected such that the plate member 91 has an allowance for forming the peripheral wall portion 93. The through hole 92 is formed at the center of the plate member 91 by the above-mentioned punching press such that the through hole 92 has a final or target inner diameter.

Next, the operator forms the peripheral wall portion 93 so as to incline in the second step. Specifically, as shown in FIG. 2(A), the operator sets the plate member 91, which has been formed in the first step, on the die 120 of die mechanism 100 which is mounted on an unillustrated pressing machine. Then, the operator moves the punch 110 downward by operating the pressing machine. As a result, as shown in FIG. 2(B), the plate member 91 is pressed against the die 120 by the punch 110, and the plate member 91 undergoes press working.

Figure 6:
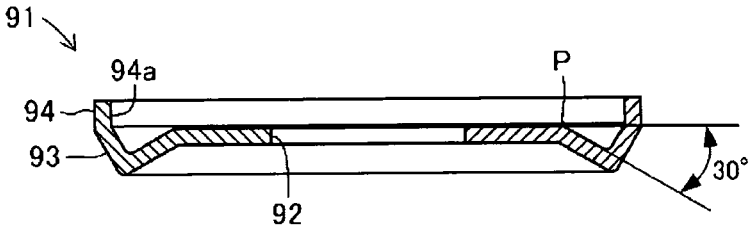
FIG. 6 is a cross-sectional view of a plate member having an inclined peripheral wall portion which is formed in the second step of the process of press forming the side plate by the undercut portion forming method according to the embodiment of the present invention.

The punch 110 and the die 120 have the male die portion 111 and the female die portion 121, respectively, on their surfaces which face the plate member 91. Therefore, the plate member 91 is formed as follows. A point on the plate member 91 located on the inner side of the inwardly inclined portion 94 of the side plate 90 is defined as a reference point P. An outer portion of the plate member 91 located on the outer side of the reference point P is bent in the pressing direction of the punch 110, and the peripheral wall portion 93 is formed on the outer side of the bent portion such that the peripheral wall portion 93 is inclined by an angle corresponding to the bending angle. In the present embodiment, as shown in FIG. 6, the peripheral wall portion 93 is formed such that it is inclined downward by 30° with respect to the horizontal direction in which the plate member 91 extends. As a result, the undercut surface 94*a* of the undercut portion 94 of the peripheral wall portion 93 is formed so as to extend in a direction parallel to the pressing direction (advancing direction) of the punch 110.

The process of bending an outer portion of the plate member 91 in the pressing direction of the punch 110 in the second step, with the outer portion being located on the outer side of the reference point P located on the inner side of the inwardly inclined portion 94 of the side plate 90, corresponds to the bending step of the present invention. The process of forming the peripheral wall portion 93 on the outer side of the bent portion in the second step corresponds to the peripheral portion forming step of the present invention. Namely, in the present embodiment, the bending step and the peripheral portion forming step are simultaneously performed in the second step.

Next, the operator corrects the inclination of the peripheral wall portion 93 in the third step. Specifically, as shown in FIG. 3(A), the operator sets the plate member 91, which has the inclined peripheral wall portion 93 formed in the second step, on the die 220 of die mechanism 200 which is mounted on an unillustrated pressing machine. At this time, the operator places the plate member 91 on the die 220 such that the convex side of the bent portion of the plate member 91 faces towards the punch 210. Subsequently, the operator moves the punch 210 downward by operating the pressing machine. As a result, as shown in FIG. 3(B), the plate member 91 is pressed against the die 220 by the punch 210. Thus, the plate member 91 undergoes press working.

The punch 210 and the die 220 have the male die portion 211 and the female die portion 221, respectively, on their surfaces which face the plate member 91. Therefore, the plate member 91 is formed as follows. After the peripheral portion of the plate member 91 is pressed against the male die portion 211 of the punch 210, the plate member 91 is pressed by the male die portion 211 and the female die portion 221, whereby the bent portion formed in the second step is formed into a flat shape. As a result, the inclined peripheral wall portion 93 is forced to rise up or extend generally vertically from the flat portion of the plate member 91. Namely, the process of removing the inclination of the peripheral wall portion 93 in the third step corresponds to the bend removal step of the present invention.

Next, the operator modifies the inclination of the peripheral wall portion 93 of the plate member 91 so as to finish the plate member 91 in the fourth step. Specifically, as shown in FIG. 4(A), the operator sets the plate member 91, the inclination of which at the peripheral wall portion 93 was modified in the third step, on the inner die 322 of die mechanism 300 mounted on an unillustrated pressing machine. In this case, the operator places the plate member 91 on the inner die 322 such that the peripheral wall portion 93 of the plate member 91 extends towards the punch 310. Then, the operator moves the punch 310 downward by operating the pressing machine. As a result, as shown in FIG. 4(B), the plate member 91 is pressed against the inner die 322 by the punch 310.

At this time, the inner die 322 slides downward within the forming through hole 321*a* due to the pressing force of the punch 310 acting on the inner die 322 through the plate member 91 against the pressing force towards the punch 310 which is applied from the pressing machine to the inner die 322 through the die receiving section 80 to press the inner die 322 towards the punch 310. As the inner die 322 moves downward, the plate member 91 is guided into the forming through hole 321*a* of the outer die 321. As a result, the plate member 91 is again pressed by the punch 310 and the inner die 322 while the external shape of the peripheral wall portion 93 is formed by the punch 310 and the forming through hole 321*a* of the outer die 321.

As a result, deformation of the plate member 91 caused by spring back or spring go after the press working in the third step is corrected, whereby the plate member 91 is formed into the final or target shape of the side plate 90. Namely, this fourth step is a process of re-striking the plate member 91 into the final or target shape of the side plate 90 and corresponds to the finishing step of the present invention.

After re-striking the plate member 91, the pressing machine is operated to move the punch 310 upward in the drawings. As a result, due to the pressing force, which is applied from the pressing machine to the inner die 322 through the die receiving section 80 to press the inner die 322 towards the punch 310, the inner die 322 moves upward, whereby the plate member 91 located within the forming through hole 321*a* of the outer die 321 is ejected to a space above the forming through hole 321*a*. Therefore, the operator removes from the pressing machine the plate member 91, i.e., the side plate 90 formed into the final or target shape, which has been ejected onto the outer die 321. This ends the press forming of the side plate 90.

As can be understood from the above-described operation, according to the above-described embodiment, a point on the plate member 91 (plate-shaped workpiece) which is located on the inner side of a portion where the inwardly inclined portion 94 (undercut portion) is to be formed is defined as a reference point P, and an outer portion of the plate member 91 located on the outer side of the reference point P is bent in the pressing direction of the punch 110 so as to form the outer portion into a target shape. Then, the outer portion is bent in the opposite direction, whereby the inwardly inclined portion 94 is formed. Namely, a portion of the plate member 91 (corresponding to the inwardly inclined portion 94) where the undercut is to be formed is once inclined in such a manner that the portion corresponding to the inwardly inclined portion 94 does not form an undercut shape as viewed in the pressing direction of the punch 110, whereby the portion (specifically, the peripheral wall portion 93) which forms the undercut shape is formed. After that, the bent portion is bent back to thereby correct the inclination. With this procedure, the side plate 90, which is an article having an undercut portion, can be formed just by press working performed using the punches 110, 210, 310 and the dies 120, 220, 320. As a result, the economic efficiency and working efficiency of the process of forming the side plate 90 can be improved.

The present invention is not limited to the above-described embodiment, and the embodiment may be modified in various ways without departing from the scope of the present invention.

For example, in the above-described embodiment, in the second step of the process of press forming the side plate 90, the peripheral wall portion 93 is inclined by an angle determined such that the undercut surface 94*a* becomes parallel to the pressing direction of the punch 110. However, the angle by which the peripheral wall portion 93 is inclined is not limited to that employed in the above-described embodiment, so long as a selected inclination angle (e.g., 30° or greater) is equal to or greater than the angle determined such that the undercut surface 94*a* becomes parallel to the pressing direction of the punch 110. Namely, the inclination angle may be an angle determined such that the undercut surface 94*a* does not form an undercut shape as viewed in the pressing direction of the punch 110. In other words, the inclination angle may be an angle equal to or greater than the angle of the undercut surface 94*a* of the inwardly inclined portion 94 relative to the pressing direction of the punch 110. This means that the bending angle of the outer portion (the peripheral wall portion 93) of the side plate 90 located outward of the reference point P is equal to or greater than an angle at which the undercut surface 94*a* which constitutes the undercut portion becomes parallel to the pressing direction of the punch 110. In other words, the bending angle falls within an angular range extending up to the angle at which the outer portion and the undercut surface 94*a* (including a portion which is to form the undercut surface 94*a*) become parallel to the pressing direction of the punch 110. For example, the angle by which the peripheral wall portion 93 is inclined may be set to 30°, 40°, 50°, 60°, 70°, or greater.

The reference point P at which the plate member 91 is bent may be any point so long as the selected point falls within a region located inward of the inwardly inclined portion 94 (within the region indicated by the dashed line arrows in FIG. 1(B)). For example, a reference point P' may be provided on the peripheral wall portion 93 of the side plate 90 as shown in FIG. 1(B). In this case, a portion of the plate member 91 located outward of the reference point P' is bent towards the outside of the side plate 90. In this case, needless to say, in the third step subsequent to the second step, the plate member 91 is bent at the reference point P' towards the opposite side so as to correct the orientation of the inwardly inclined portion 94.

In the above-described embodiment, the forming of the peripheral wall portion 93, including the inwardly inclined portion 94, and the bending work for inclining the peripheral wall portion 93 are simultaneously performed on the plate member 91 in the second step of the process of press forming the side plate 90. However, the work of forming the peripheral wall portion 93 (including the inwardly inclined portion 94) and the bending work for inclining the peripheral wall portion 93 need not be performed simultaneously on the plate member 91. Namely, the bending work for inclining the peripheral wall portion 93 may be performed after just the work for forming the peripheral wall portion 93 is performed on the plate member 91. Alternatively, after bending work for previously inclining a portion where the peripheral wall portion 93 is to be formed is performed on the plate member 91, the peripheral wall portion 93 may be formed on the outer portion which has undergone the bending work.

In the above-described embodiment, in the fourth step of the process of press forming the side plate 90, the re-striking step of finishing the peripheral wall portion 93 is performed on the plate member 91. However, this re-striking step in the fourth step is not required when the plate member 91 can be formed into the final or target shape in the third step. For example, when the allowable range (dimensional tolerance) of forming accuracy of the peripheral wall portion 93 of the side plate 90 is relatively wide, the side plate 90 can be formed into the final or target shape just by the process of correcting the inclination of the peripheral wall portion 93 in the third step, at which time the press forming of the side plate 90 can be ended.

In the above-described embodiment, the undercut portion forming method of the present invention is applied to a process of forming the side plate 90, which is a component of a lockup damper apparatus of a torque converter mounted on a vehicle such as an automobile. However, the undercut portion forming method of the present invention can be broadly applied to articles which are formed from a plate-shaped workpiece by press working and which have undercut portions. The present invention can also be implemented as a method for manufacturing a formed article having an undercut portion.

DESCRIPTION OF REFERENCE SYMBOLS

P, P': reference point
80: die receiving section
90: side plate
91: plate member
92: through hole
93: peripheral wall portion
94: inwardly inclined portion
94*a*: undercut surface
100, 200, 300: die mechanism
110, 210, 310: punch
120, 220, 320: die
111, 211, 311: male die portion
121, 221, 322*a*: female die portion
321: outer die
321*a*: forming through hole
322: inner die

The invention claimed is:

1. A press working method comprising:

pressing a flat workpiece to form a first bend in the workpiece spaced from a center of the workpiece, a second bend in the workpiece disposed further from the center of the workpiece than the first bend, and a third bend in the workpiece disposed further from the center of the workpiece than the second bend while maintaining a central region of the workpiece flat to define a first region which slopes away from a plane parallel to the central region from the first bend to the second bend, a second region which slopes towards the plane from the second bend to the third bend, and a third region extending from the third bend to an outer edge of the workpiece; and then pressing the workpiece to remove the first bend and make the first region coplanar with the central region to obtain an article having a planar bottom formed by the first region and the central region of the workpiece, a peripheral wall formed by the second region and extending upwards from the bottom, and an inwardly inclined portion formed by the third region and extending inwardly from the peripheral wall toward a center of the article and defining an undercut.

2. A press working method as claimed in claim 1 wherein each of the first, second, and third bends extends completely around the center of the workpiece.

3. A press working method as claimed in claim 1 including simultaneously forming the first through third bends.

4. A press working method as claimed in claim 1 wherein the third bend is formed such that the third region extends parallel to a line normal to the central region prior to removing the first bend.

5. A press working method as claimed in claim 1 wherein the workpiece comprises a circular plate.

6. A press working method as claimed in claim 1 wherein the second bend is formed such that the second region is substantially perpendicular to the first region.

7. A press working method as claimed in claim 1 further comprising passing the article through a hollow die to adjust a shape of the peripheral wall.

8. A press working method as claimed in claim 1 wherein the undercut is frustoconical.

9. A press working method as claimed in claim 1 wherein the second region is frustoconical prior to removing the first bend, and the peripheral wall of the article is cylindrical.

10. A press working method comprising:

pressing a flat circular workpiece to simultaneously form a first bend in the workpiece spaced from a center of the workpiece, a second bend in the workpiece disposed further from the center of the workpiece than the first bend, and a third bend in the workpiece disposed further from the center of the workpiece than the second bend while maintaining a central region of the workpiece flat to define a first region which slopes away from a plane parallel to the central region from the first bend to the second bend, a second region which slopes towards the plane from the second bend to the third bend and extends substantially perpendicular to the first region, and a third region which slopes with respect to the second region from the third bend to an outer edge of the workpiece, each of the first, second, and third bends extending completely around the center of the workpiece; and then pressing the workpiece to remove the first bend and make the first region coplanar with the central region to obtain an article having a planar bottom formed by the first region and the central region of the workpiece, a peripheral wall formed by the second region and extending upwards from the bottom substantially perpendicular to the bottom, and an inwardly inclined portion formed by the third region and extending inwardly from the peripheral wall toward a center of the article and defining an undercut.

* * * * *